US012017845B2

(12) United States Patent
Pherson

(10) Patent No.: US 12,017,845 B2
(45) Date of Patent: Jun. 25, 2024

(54) INTERLOCKING MODULAR PHASE CHANGE MATERIAL SYSTEM FOR CARGO CONTAINER

(71) Applicant: Advanced Composite Structures, LLC, Charleston, SC (US)

(72) Inventor: Thomas R. Pherson, Daniel Island, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 63 days.

(21) Appl. No.: 17/784,387

(22) PCT Filed: Dec. 11, 2020

(86) PCT No.: PCT/US2020/064551

§ 371 (c)(1),
(2) Date: Jun. 10, 2022

(87) PCT Pub. No.: WO2021/119453

PCT Pub. Date: Jun. 17, 2021

(65) Prior Publication Data

US 2023/0050746 A1 Feb. 16, 2023

Related U.S. Application Data

(60) Provisional application No. 62/947,272, filed on Dec. 12, 2019.

(51) Int. Cl.
*B65D 88/74* (2006.01)
*F25D 3/06* (2006.01)

(52) U.S. Cl.
CPC ..... *B65D 88/74* (2013.01); *F25D 3/06* (2013.01); *F25D 2303/08221* (2013.01); *F25D 2303/08222* (2013.01); *F25D 2303/0843* (2013.01)

(58) Field of Classification Search
CPC . B65D 88/74; F25D 3/06; F25D 2303/08221; F25D 2303/08222;
(Continued)

(56) References Cited

U.S. PATENT DOCUMENTS 10,501,254 B2 * 12/2019 Wood ..... B31B 50/81
10,508,854 B2 * 12/2019 Demuth ..... F25D 21/14
(Continued)

FOREIGN PATENT DOCUMENTS

WO WO 2017/060695 A1 4/2017

OTHER PUBLICATIONS

International Search Report in PCT/US2020/064551, Mar. 31, 2021.

*Primary Examiner* — Shawn M Braden
(74) *Attorney, Agent, or Firm* — Womble Bond Dickinson (US) LLP

(57) ABSTRACT

A cargo container includes a plurality of panels, a first set of rales, a first pack, and a second pack. The plurality of panels defines a chamber that has an opening configured for loading and unloading of cargo in the chamber. The plurality of panels includes a first panel with the first set of rails connected to the first panel and disposed within the chamber. The first pack and the second pack are slidably received on the first set of rails and each include a phase-change material (PCM) disposed therein. The first pack and the second pack are interlocked with one another such that the first pack and the second pack slide in concert with one another.

19 Claims, 8 Drawing Sheets

(58) Field of Classification Search
CPC ..... F25D 2303/0843; F25D 2303/0822; F25D 2500/02
See application file for complete search history.

(56) References Cited

U.S. PATENT DOCUMENTS

| | | | | |
|---|---|---|---|---|
| 2007/0186577 | A1 | 8/2007 | Goncharko | |
| 2007/0289976 | A1 | 12/2007 | Meyer et al. | |
| 2012/0072046 | A1 | 3/2012 | Tattam | |
| 2015/0191291 | A1 | 7/2015 | Wood et al. | |
| 2017/0066582 | A1* | 3/2017 | Vogel | B65D 81/3834 |
| 2017/0121097 | A1* | 5/2017 | Pranadi | B65D 19/06 |
| 2017/0280937 | A1* | 10/2017 | Mogil | A47J 41/0066 |

* cited by examiner

INTERLOCKING MODULAR PHASE CHANGE MATERIAL SYSTEM FOR CARGO CONTAINER

BACKGROUND

Technical Field

The present disclosure generally relates to the field of transportation, and, particularly, to cargo containers for aircraft. More specifically, the present disclosure relates to systems and methods for temperature control in such containers. Other aspects also are described.

Discussion of Related Art

Cargo is typically transported in containers such as Unit Load Devices (ULDs), which are stowed in cargo holds either below the deck of passenger aircraft or below and above the deck in transport aircraft. Often times, cargo within these containers needs to be maintained within a desired temperature range before or after they are loaded into an aircraft, and as such, there generally is a continuing need for improved temperature control assemblies or systems for such containers.

SUMMARY

In an embodiment of the present disclosure, a temperature control assembly or system for an air cargo container is provided. The temperature control assembly can include a plurality of a modular, interlocking packs, bottles, or other suitable containers that contain a phase change material ("PCM"). The modular interlocking packs can be configured to be received within the air cargo container, e.g., to facilitate temperature control, such as cooling, heating, or maintenance of a prescribed temperature, within the container. The PCM can include water and/or a wide variety of organic or inorganic material (solid, liquid, or gaseous materials) that can absorb or release energy at selected temperatures, that change phase at various temperatures in a range of −100° C. to 100° C. In some embodiments, the PCM may melt or boil at a temperature above 100° C. The interlocking packs accordingly can be cooled (e.g., such that the water or other PCM therein is frozen or otherwise solidified or liquefied) and can be placed into the container to facilitate cooling or other temperature control within the container.

In embodiments, the interlocking packs can be received along and supported and/or engaged by one or more rail systems including a plurality of rails or supports mounted or otherwise connected to one or more panels, walls, etc. of the air cargo container. More specifically, the rail systems can include sets of rails that are configured to receive and support and/or engage the interlocking packs. For example, each of the sets of rails can include a first (e.g., an upper or left) rail and a second (e.g., a lower or right) rail and groups or sets of interlocking packs can be received between the first and second rails for supporting and/or engaging the interlocking packs along the panels, walls, etc. of the air cargo container.

In one example construction, the rails can include half-round rails that are configured to be at least partially received within grooves or slots provided in and/or along the interlocking packs. For example, each of the interlocking packs can include grooves on opposing first (e.g., upper or left) and second (e.g., lower or right) sides of the interlocking packs. The grooves on the first side of the interlocking packs can receive at least a portion of a first rail of the set of rails, and the grooves on the second side of the interlocking packs can receive at least a portion of a second rail of the set of rails.

In embodiments, the interlocking packs also can include interlocking features or mechanisms that facilitate interlocking or other suitable connection of adjacent interlocking packs along the rails. For example, a distal portion or end of each interlocking pack can include a first interlocking feature, and an opposing proximal portion or end of each interlocking pack can include a second interlocking feature. The first interlocking feature can be configured to interlock or otherwise engage with the second interlocking feature of an adjacent interlocking pack. Accordingly, interlocking packs received along the sets of rails can be interlocked or otherwise engaged to form groups of interlocking packs. The groups of interlocking packs can be moved and removed when a user pulls or otherwise engages one of the interlocking packs (e.g., an outermost interlocking pack) of each group. That is, each group of interlocking packs can be removed from its corresponding set of rails when a user engages and pulls on one of the interlocking packs in the group (e.g., a forward most or rearward most interlocking pack of each group), and thus, the groups of interlocking packs (or even individual interlocking packs) can be replaced even if the container is substantially full of cargo.

In one example construction, the first and second interlocking features each can include fingers or other suitable portions that are configured to be intermeshed, interlocked, or otherwise engaged with each other for interlocking of adjacent interlocking packs.

For example, a first interlocking pack can be slid or otherwise received between a first rail and a second rail of a set of rails (e.g., such that at least a portion of the first and second rails are received within the corresponding grooves of the first interlocking pack). Thereafter, a second interlocking pack can be slid into or otherwise received between the first and second rails of the set of rails (e.g., such that at least a portion of the first and second rails are received within the corresponding grooves of the first interlocking pack). When the second interlocking pack is slid in between the set of rails and into engagement with the first interlocking pack, the second interlocking pack can be interlocked with the first interlocking pack. More specifically, a finger of a first interlocking feature on a distal end of the second interlocking pack can be intermeshed, interlocked, or otherwise engaged with a finger of a second interlocking feature on a proximal end of the first interlocking pack to form a group of interlocking packs. Furthermore, an additional, third interlocking pack can be slid in-between the set of rails and interlocked with the second interlocking pack to be added to the group of interlocking packs. The group of interlocking packs can be removed from the set of rails by engaging and pulling on the third interlocking pack.

Accordingly, all interlocking packs can be inserted and also removed from one side (e.g., a front side) of the container. That is, with adjacent interlocking packs being interlocked or connected together as a group, an outermost interlocking pack can be engaged or pulled (e.g., a user can engage and pull a handle or other engagement portion of the outermost interlocking pack) to remove the group of interlocking packs from the set of rails, e.g., together as a unit. This can allow for the interlocking packs to be changed/replaced when the container is substantially filled with cargo. For example, after the PCM material of the interlocking packs has melted or otherwise changed phases, the interlocking packs can be removed and replaced with additional cooled interlocking packs, e.g., with frozen or otherwise solid (or liquid) PCM, for cooling or other temperature control within the container.

In an embodiment of the present disclosure, a cargo container includes a plurality of panels, a first set of rales, a first pack, and a second pack. The plurality of panels defines a chamber that has an opening configured for loading and unloading of cargo in the chamber. The plurality of panels includes a first panel with the first set of rails connected to the first panel and disposed within the chamber. The first pack and the second pack are slidably received on the first set of rails and each include a phase-change material (PCM) disposed therein. The first pack and the second pack are interlocked with one another such that the first pack and the second pack slide in concert with one another.

In embodiments, the first pack and the second pack are removable and replaceable from within the chamber when the chamber is full of cargo. The cargo container may include a closure that has an open position in which the chamber is accessible through the opening and a closed position in which the opening is substantially closed such that the closure prevents access to cargo within the chamber. The first pack and the second pack may be removable from within the chamber when the closure is in the closed position.

In some embodiments, the first pack includes a first attachment assembly and the second pack includes a second attachment assembly. The first attachment assembly of the first pack may be interlocked with the second attachment assembly of the second pack. The cargo container may include a third pack that is slidably received on the first set of rails and interlocked with the second pack such that the first pack, the second pack, and the third pack slide on the first set of rails in concert with one another. The third pack including a PCM disposed therein. The second pack may include a first attachment assembly opposite the second attachment assembly thereof. The third pack may include a second attachment assembly that is interlocked with the first attachment assembly of the second pack. The first attachment assembly and the second attachment assembly may each include a finger that is configured to interlock with a finger of an adjacent attachment assembly.

In certain embodiments, the first pack and the second pack each include grooves or slots on opposite sides thereof. Each groove or slot is configured to receive a rail of the set of rails to secure a respective one of the first pack or the second pack to the set of rails.

In particular embodiments, the first pack and the second pack each include a handle to facilitate loading and removal thereof. The handle may be a through hole that is defined in a body the respective pack. The first panel may be a side panel or a top panel.

In another embodiment of the present disclosure, a method of loading a cargo container includes inserting a first pack along a first set of rails, interlocking a second pack with the first pack, and inserting the second pack on the set of rails. Inserting the first pack includes the set of rails being connected to a panel of a cargo container. The first pack and the second pack include a phase-change material (PCM) in a first state. Interlocking the second pack with the first pack includes the first pack is on the set of rails. Inserting the second pack may include the first pack being inserted further along the set of rails as the second pack is inserted.

In embodiments, the method includes loading the cargo container with cargo before inserting the first pack. The method may include, closing a curtain of the cargo container such that access to cargo within a chamber of the cargo container is prevented before inserting the first pack.

In some embodiments, the method includes removing the first pack and the second pack when the cargo container is full of cargo and inserting a third pack and a fourth pack on the set of rails after removing the first pack and the second pack. The third pack interlocked with the fourth pack. Removing the first pack and the second pack may include engaging a handle of the second pack and pulling the second pack out of the cargo container such that the first pack, which is interlocked with the second pack, is pulled out of the cargo container with the second pack. Removing the first pack and the second pack may include a closure of the container being in a closed position such that access to cargo within the cargo container is prevented.

In another embodiment of the present disclosure, a temperature control pack assembly for a cargo container includes a first temperature control pack and a second temperature control pack. Each of the first temperature control pack and the second temperature control pack include a body that defines a cavity therein. The cavity includes a phase-change material (PCM) disposed therein. The body has a first interlocking feature on a first side of the body and a second interlocking feature on a second side of the body, opposite of the first side. The first interlocking feature of the first temperature control pack is configured to interlock with the second interlocking feature of the second temperature control pack such that the first temperature control pack and the second temperature control pack are interlocked on end with one another such that the temperature control pack assembly has a length equal to the sum of the length of the first temperature control pack and the second temperature control pack.

Further, to the extent consistent, any of the embodiments described herein may be used in conjunction with any or all of the other embodiments described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
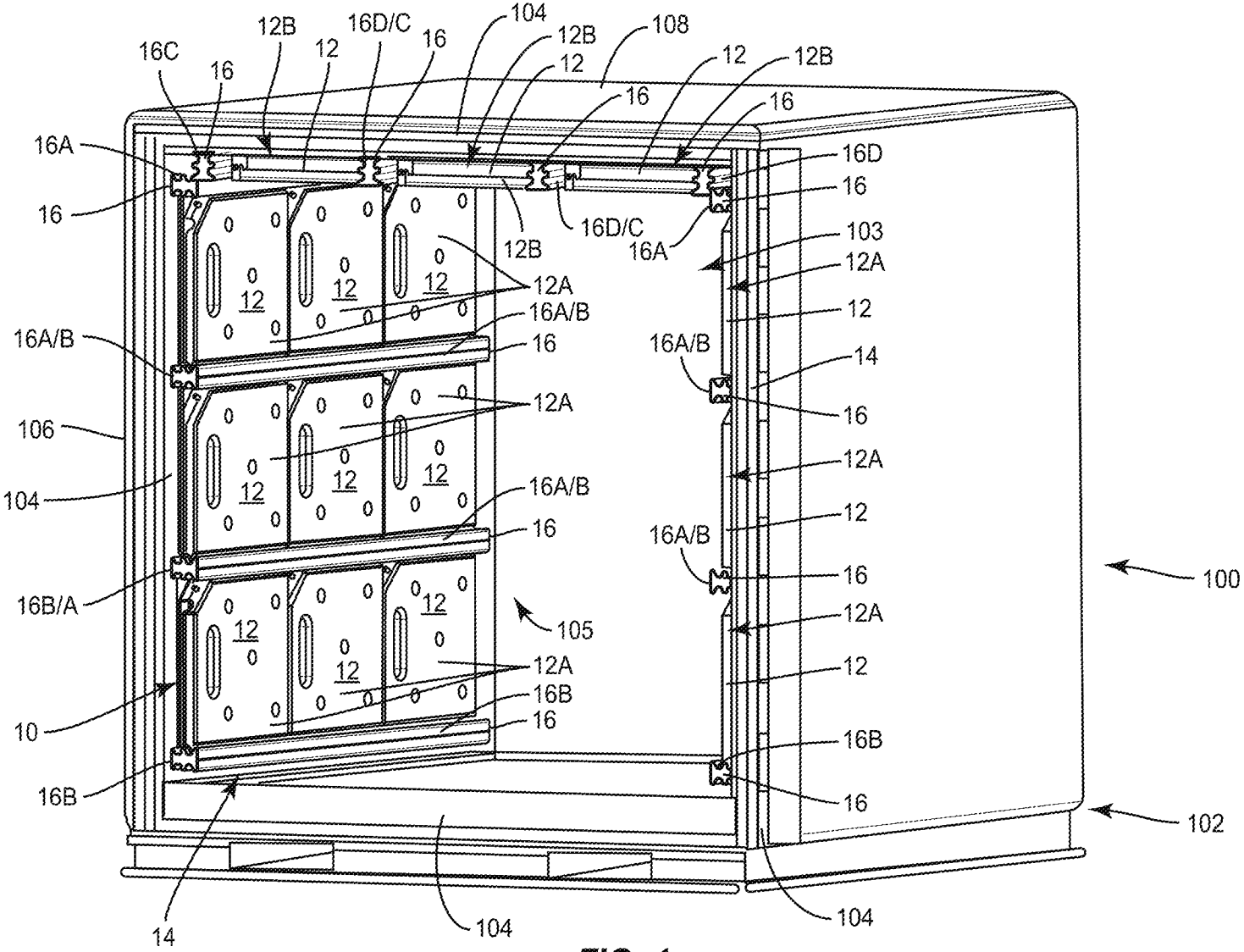
FIG. 1 is a perspective view of a cargo container with an exemplary embodiment of a temperature control assembly provided in accordance with the present disclosure.
Figure 2A:
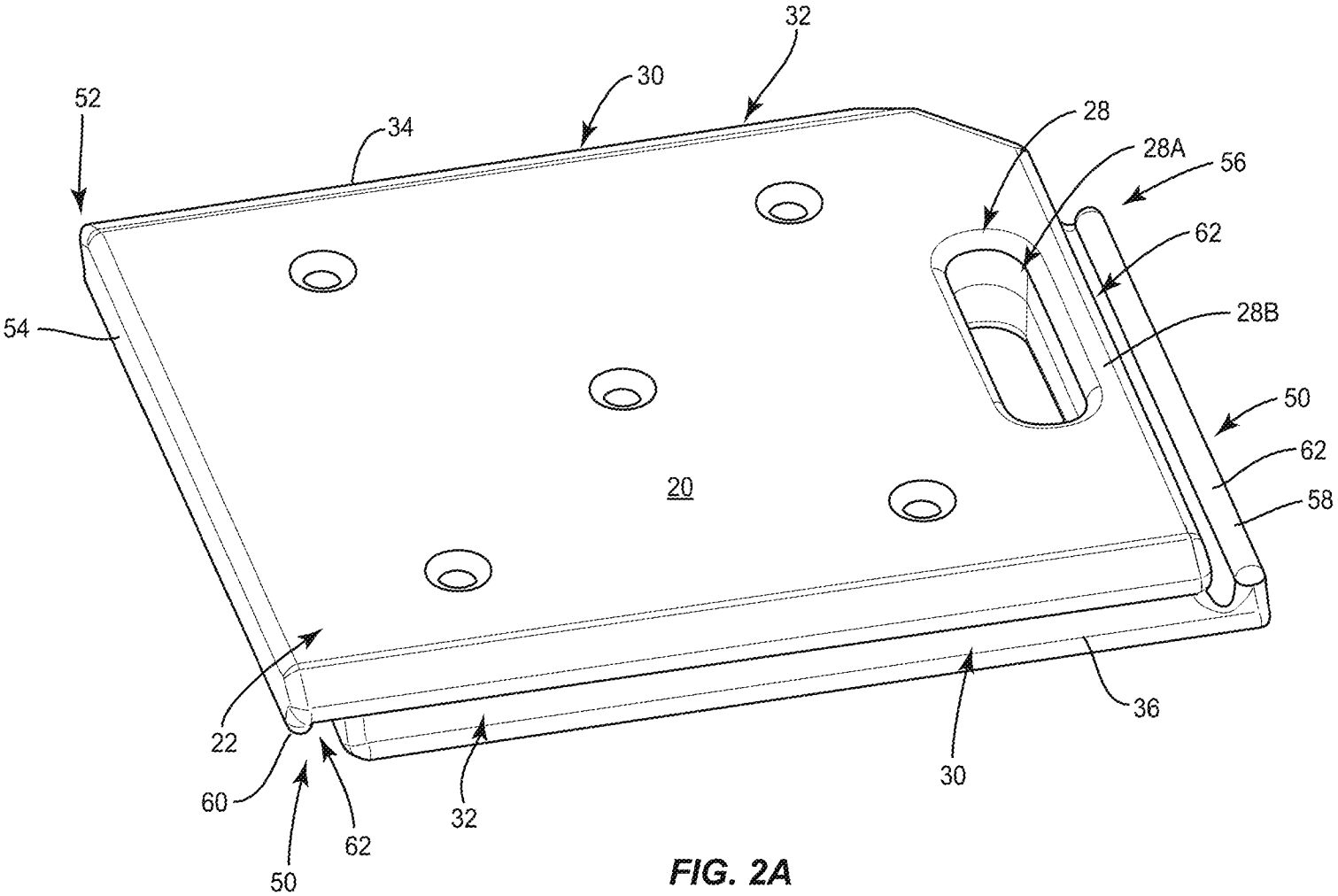
FIGS. 2A, 2B, 2C, and 2D show perspective, front, rear, and top views of an exemplary interlocking pack of the temperature control assembly in accordance with the present disclosure.
Figure 2B:
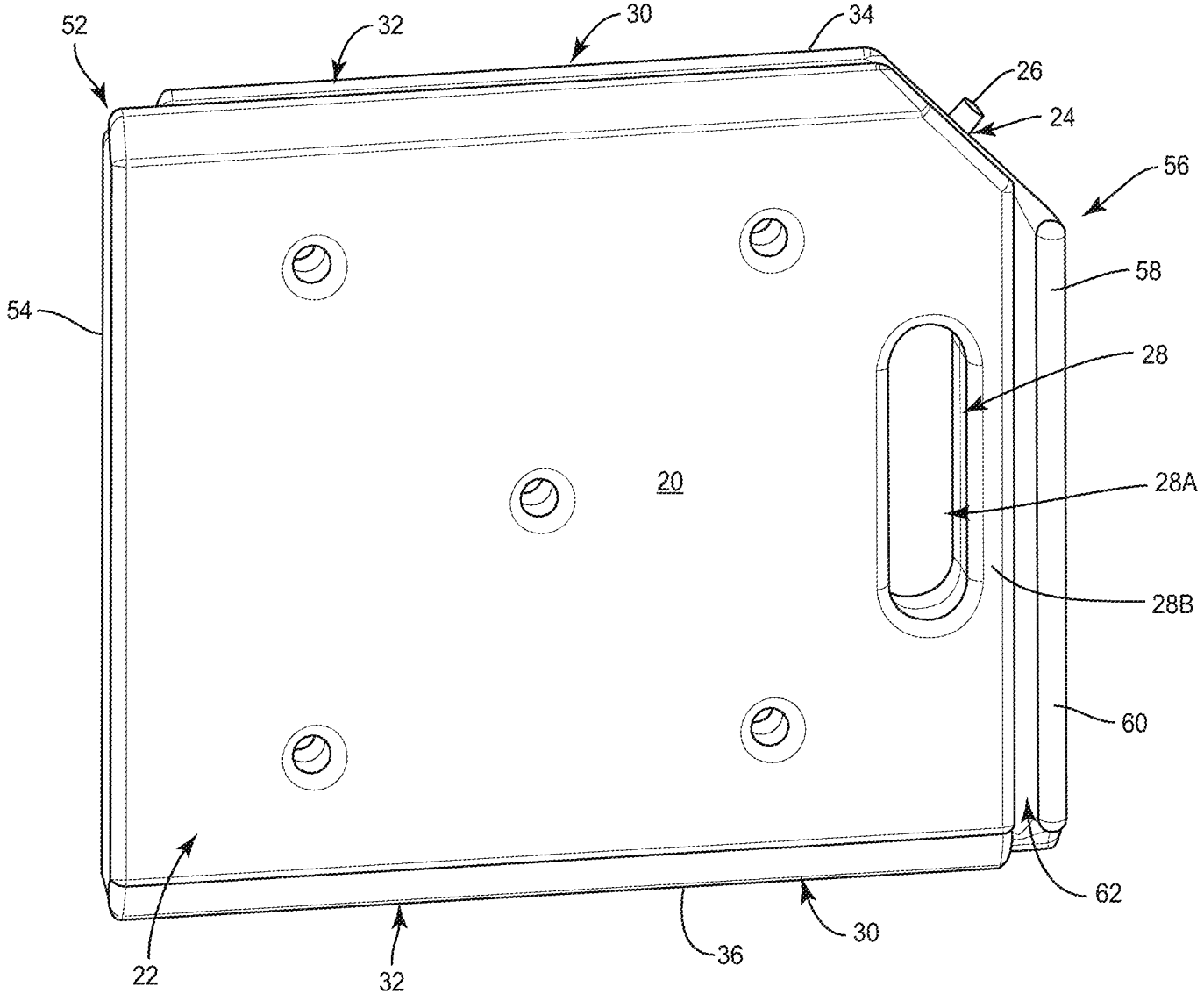
Figure 2D:
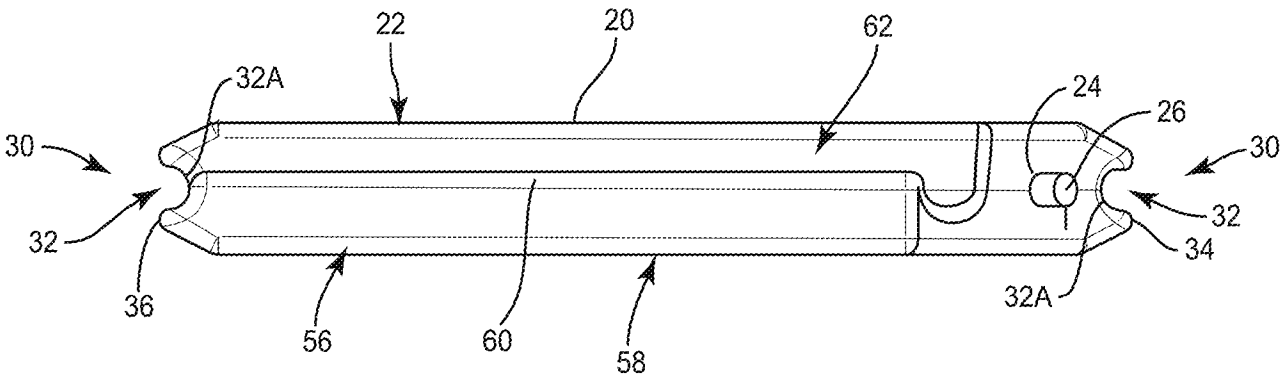
Figure 2C:
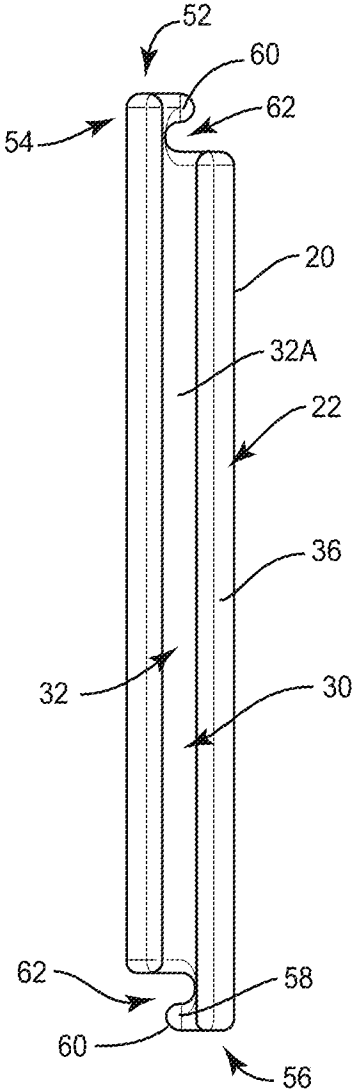

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used in the description and the appended claims, the phrase "unit load devices (ULDs)" also known as "air cargo containers," is defined as containers used to load luggage, freight, mail, and the like on wide-body aircraft and some specific narrow-body aircraft.

Referring now to FIG. 1, an air cargo container or ULD or simply container 100 includes a thermal management assembly or system 10 provided in accordance with principles of the present disclosure. The container 100 may include a frame 102 presenting a generally rectangular shape, though other suitable shapes, such as rectangular shape with one or more effects, are possible. The container 100 may further include a cargo opening 103 defined by a portion of the frame 102. The frame 102 may be formed from any substantially rigid material, such as aluminum, steel, composites, temperature resistant plastics, and other metals and non-metals.

The frame 102 may support a plurality of panels 104 forming the walls, and optionally the roof and floor of the container 100. In some embodiments, the panels 104 may be constructed together such that a separate frame may be eliminated. The panels 104 may be a composite panel for at least their lightweight, thermal insulating, and high strength characteristics. Alternatively, the panels 104 may also include aluminum, aluminum or Lexan composite, webs, fabrics, or some other lightweight material. The panels 104 further can include or otherwise integrate vacuum insulated panels. Exemplary vacuum insulated panels are disclosed in U.S. patent application Ser. No. 16/913,410, filed Jun. 26, 2020, the entire contents of which are hereby incorporated by reference. The cargo opening 103 may be substantially sealed, and selectively closed, by a door, curtain, gate, etc. (not shown). The plurality of panels 104 can at least partially define a cargo chamber 105 sized, dimensioned, or otherwise configured for the receipt of cargo (e.g., luggage, freight, mail, etc.) therein. The cargo opening 103 can provide access to the cargo chamber 105 to facilitate loading, unloading, etc. of cargo therein.

FIG. 1 further shows that the temperature control assembly 10 includes a plurality of a modular, interlocking packs or bottles 12 configured to be received within the container 100 to facilitate temperature control, e.g., cooling, heating, or maintenance of a prescribed temperature, within the container 100. The interlocking packs 12 can include a phase change material ("PCM"), and the interlocking packs 12 can be cooled (e.g., such that the PCM, e.g., water or other PCM, is frozen or rendered solid) and placed into the container 100 to facilitate cooling, or other suitable temperature control, within the chamber 105.

As further indicated in FIG. 1, the interlocking packs 12 can be received along and supported and/or engaged by a rail system 14 including a plurality of rails or supports 16 mounted or otherwise connected to one or more of the panels 104 of the cargo container 100. The rail system 14 can include sets of rails, e.g., 16A/16B and 16C/16D, that are configured to receive and support and/or engage the interlocking packs 12 therebetween. For example, the sets of rails can include an upper rail 16A and a lower rail 16B and a group or set 12A of interlocking packs 12 can be received between and engaged and/or supported by the upper 16A and lower 16B rails for supporting the group 12A interlocking packs 12 along one of the panels 104 (e.g., such as a side panel 106 of the plurality of panels 104). Furthermore, the sets of rails can include a left rail 16C and a right rail 16D and another set or group 12B of interlocking packs can be received between and engaged by the left 16C and right 16D rails for supporting the group 12B of interlocking packs along another panel 104 (e.g., a panel 108 that defines a roof of the container 100).

Referring now to FIGS. 2A-2D and 3A-3B, each interlocking pack 12 of the plurality of interlocking packs 12 generally includes a body 20 that surrounds and defines one or more substantially sealed chambers or cavities 22 configured for the receipt of the phase change material ("PCM"). The body 20 of each interlocking pack 12 can be formed from a plastic(s) or other suitable polymeric material(s); however, the body 20 can be formed from any other suitable materials, e.g., synthetic, composite, etc., materials, or combinations thereof, without departing from the scope of the present disclosure. The PCM can include water and a wide variety of organic or inorganic material (solid, liquid, or gaseous materials) that can absorb or release energy at selected temperatures. Other suitable PCMs, such as refrigerant gel, liquid, solid, etc., as will be understood by those having skill in the art also can be employed. or other suitable PCM, such as a refrigerant gel, liquid, etc., as will be understood by those having skill in the art also can be employed. The PCM can melt, boil, or otherwise change phases in a range of −100° C. to 100° C. In some embodiments, the PCM may change phases at a temperature below −100° C. or at a temperature above 100° C. The interlocking packs 12 accordingly can be cooled to freeze, solidify, liquefy, or otherwise change the phase of the PCM, and thereafter, the interlocking packs 12 can be inserted into the chamber 105 of the container 100 to provide cooling or other suitable temperature control within the chamber 105.

In the illustrated embodiment, the body 20 of the interlocking packs 12 is shown to have a generally rectangular shape with a cut out or beveled portion; however, the body 20 can take on any suitable shapes or configurations without departing from the scope of the present disclosure. The body 20 further can include an opening 24 defined therealong that is sized or configured to facilitate receipt of the PCM within the chamber 22. In addition, a cap or other suitable portion 26 can be received over the opening 24 for sealing of the opening 24. The cap 26 can be integrally formed with the body 20, though the cap 26 can be removable without departing form the scope of the present disclosure.

The body 20 of each interlocking pack 12 additionally includes one or more engagement features 28 that facilitate loading and removal of the interlocking packs 12 along the rails 16. The engagement features 28 can include an opening 28A defined through the body 20 of the interlocking packs 12. The opening 28A can define a handle or other engagement portion 28B that can be engaged by a user to load and/or remove the packs 12.

In embodiments, the body 20 of the interlocking packs 12 further can include one or more guidance features 30 formed along the body 20, as generally indicated in FIGS. 2A-2D, 3A-3B, and 4A-4B. For example, in one construction, the guidance features 30 can include grooves or slots 32 formed in a first (e.g., upper or left) side 34 and an opposing, second (e.g., lower or right) side 36 of the body 20. The grooves or slots 32 can be sized, dimensioned, or otherwise configured to receive at least a portion of one of the rails 16, e.g., for guidance, alignment, etc. of the interlocking packs 12 as/when the interlocking packs 12 are received within/along the opposing sets of rails 16.

Figure 4A:
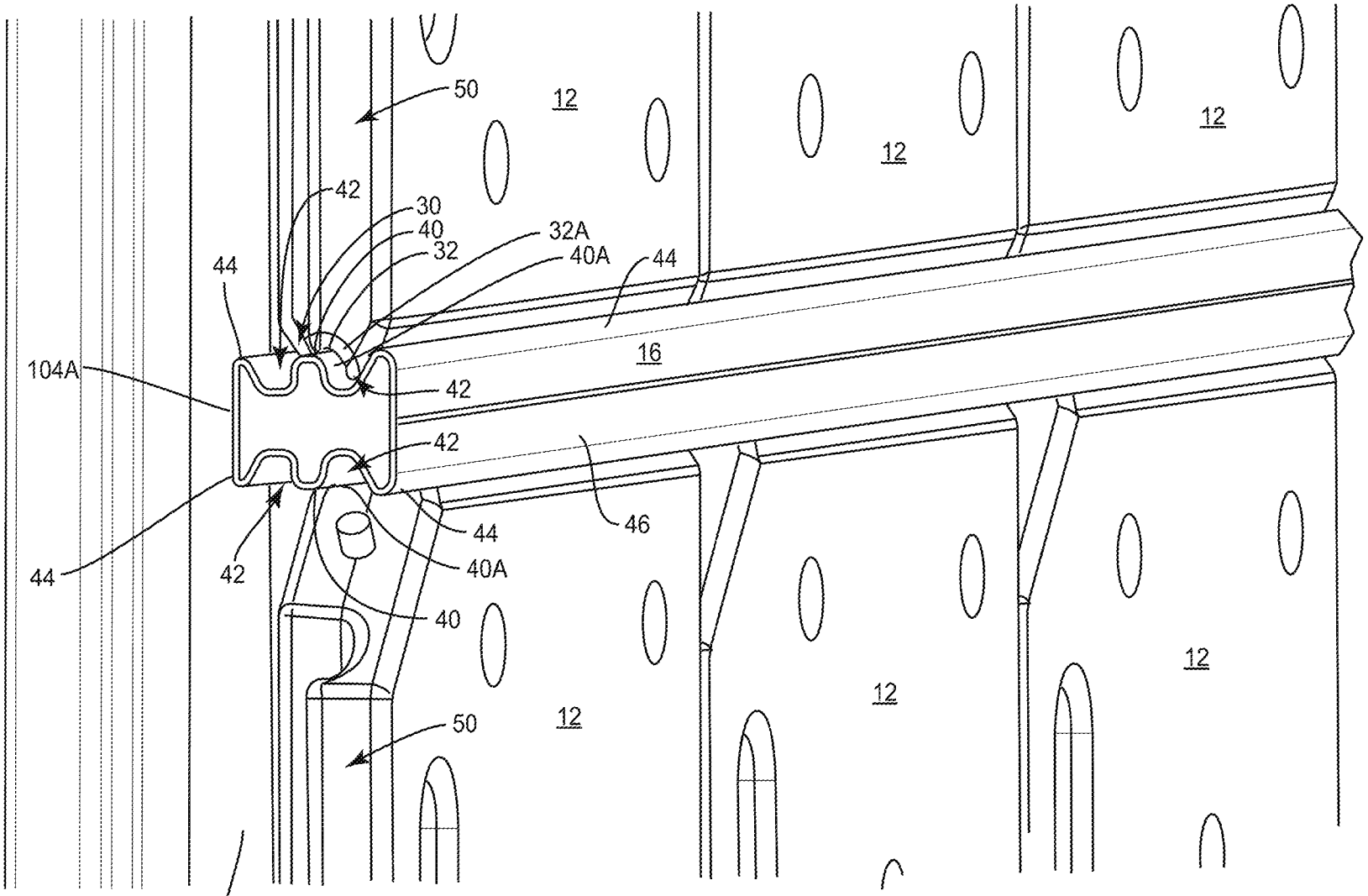
FIGS. 4A and 4B illustrate perspective and front views of an example rail of a rail system supporting and/or engaging interlocking packs in accordance with the present disclosure.
Figure 4B:
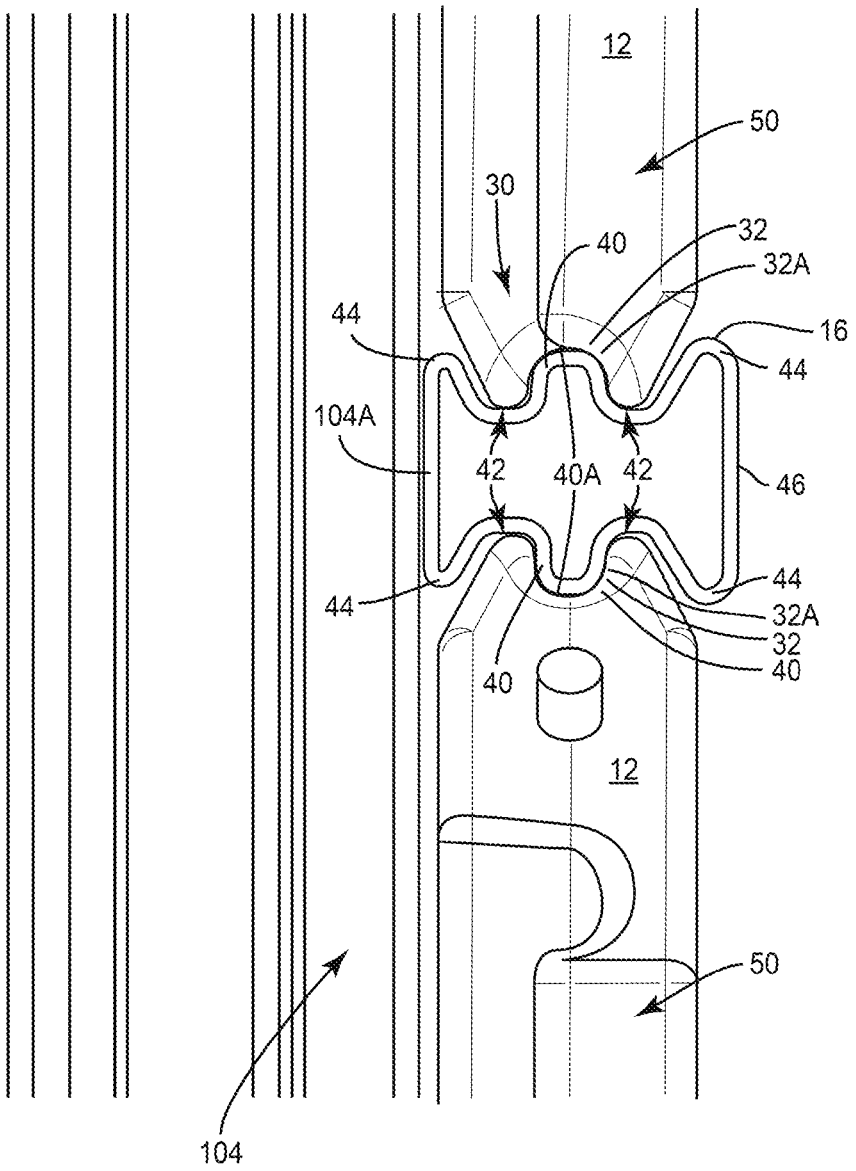

In one example construction, as shown in FIGS. 4A and 4B, each rail 16 can include can include a half-round rail that is configured to be at least partially received within a groove 32 defined along the interlocking packs 12. More specifically, each rail 16 can include a projecting portion or protuberance 40 that is configured to be received within a corresponding groove 32 of an interlocking pack 12 supported or engaged by the rail 16, as generally indicated in FIGS. 4A and 4B. The protuberances 40 can be sized, shaped, or otherwise configured to be generally complementary or otherwise conform to the grooves 32. For example, a surface 40A of the protuberances 40 can engage, such as be in face-to-face contact with, a surface 32A defined by/along the groove 32. The rails 16 also can have grooves or slots 42 on opposing sides of the protuberances 40 that are sized, dimensioned, or otherwise configured to receive portions of the interlocking packs 12. Furthermore, the rails 16 can have additional projecting portions 44 that also can contact or otherwise engage portions of the interlocking packs 12.

FIGS. 4A and 4B further indicate that the rails 16 generally are symmetrical about an axis thereof, e.g., such that the rails 16 include protuberances 400, grooves 402, and additional protuberances 404 on opposing sides. Accordingly, the rails 16 can be configured to support and/or engage interlocking packs 12 along opposing sides of the rails 16. The rails 16 thus can be configured to act as a first (e.g., upper or left) rail for engaging or supporting one group of interlocking packs 12, and can be configured to act as a second (e.g., lower or right) rail for engaging or supporting another group of interlocking packs 12.

In addition, as shown in FIGS. 4A and 4B, the rails 16 can include a substantially hollow body 46; though the body 46 can be generally solid without departing from the scope of the present disclosure. In embodiments, the body 46 can be formed from extruded "self-lubricated" plastic materials, such as Nylon, HDPE, Acetel, etc.; though other polymeric, synthetic, or composite materials that allow for sliding between the rails 16 and packs 12 also can be used without departing from the scope of the present disclosure. The body 46 of the rails 16 can be formed from a pultruded composite material in additional or alternative constructions. The rails 16 can be attached to the panels 104 (e.g., to a surface 104A thereof) by an adhesive, such as structural adhesive tape or other suitable adhesive; though fasteners and/or other connection mechanisms also can be used without departing from the scope of the present disclosure.

The rails 16 generally extend along the panels 104 to support the groups 12A/12B of interlocking packs 12 that are interlocked on end with one another as shown in FIG. 1. FIG. 1 shows that the rails 16 can be sized or otherwise configured to support up to three (3) interlocking packs 12; through the rails 16 can be configured to support any suitable number of interlocking packs, such as two, four, five, or six or more interlocking packs 12. FIG. 1 shows that the rails 16 are generally sized to extend substantially across a length the panels 4; however, the rails 16 can include a plurality of separate segments or sections aligned to be coaxial that extend across a length of the panels.

As further shown in FIG. 4B, the rails 16 generally extend into the chamber 105 of the container 100 at a distance that is greater than a width of the interlocking packs 12. That is, the rails 16 can extend or protrude passed the interlocking packs 12 into the chamber 105, e.g., to prevent, inhibit, or reduce impingement or engagement of the cargo into the rails 16. As a result, the interlocking packs 12 may still be removed even if the cargo shifts inside the container 100.

In embodiments of the present disclosure, the interlocking packs 12 further can include interlocking features or mechanisms 50 that facilitate interlocking or other suitable engagement of adjacent interlocking packs 12. For example, as generally shown in FIGS. 2A-2B and 3A-3B, a distal portion or end 52 of each of the interlocking packs 12 can include a first interlocking feature 54, and a proximal portion or end 56 of each of the interlocking packs 12 can include a second interlocking feature 58. The first interlocking feature 54 generally is configured to intermesh, interlock, or otherwise engage the second interlocking feature 58 of an adjacent interlocking pack 12 to interlock or otherwise connect the packs 12 together.

Figure 3A:
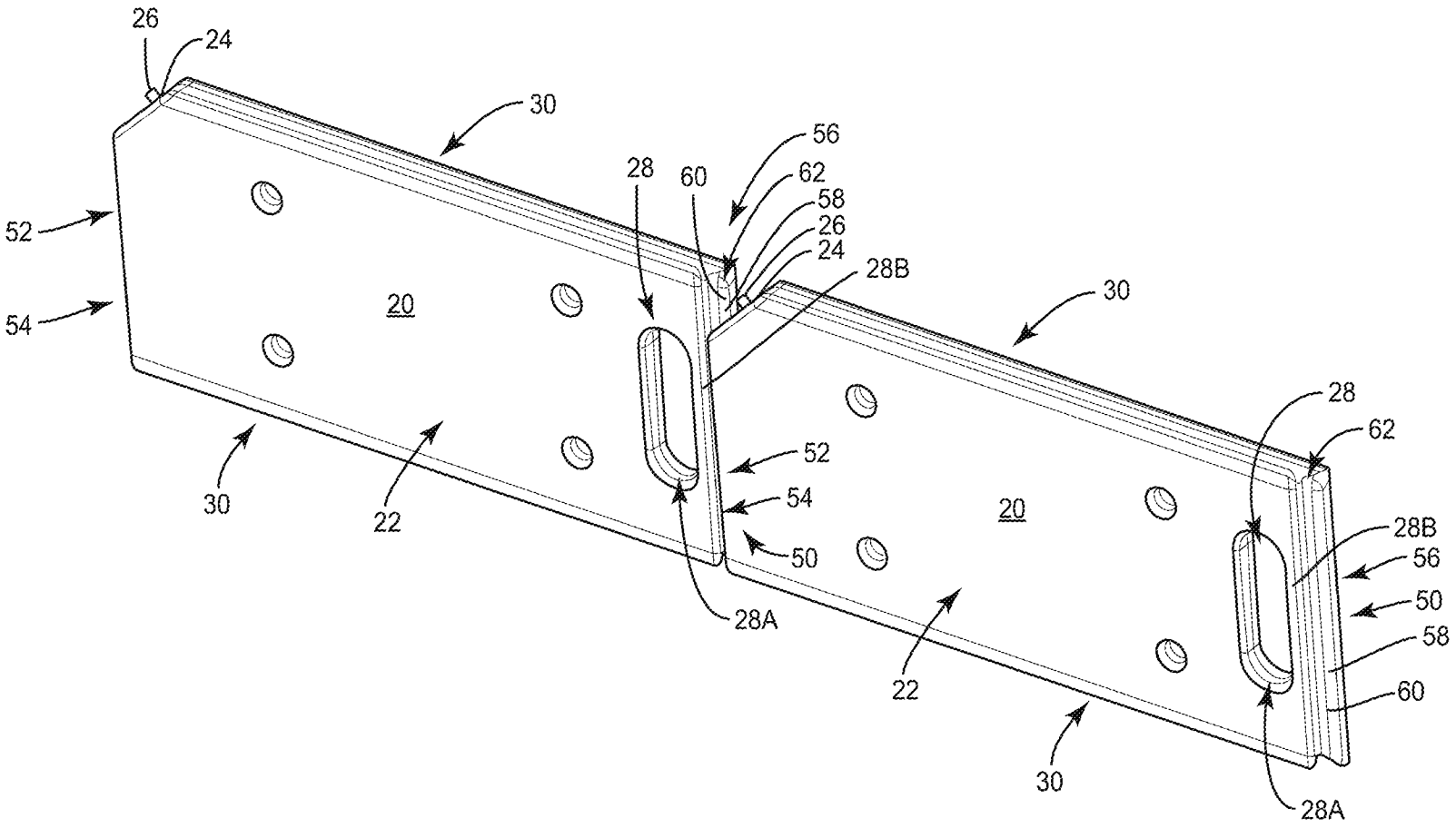
FIGS. 3A and 3B show perspective and top views of engaged adjacent interlocking packs in accordance with the present disclosure.
Figure 3B:
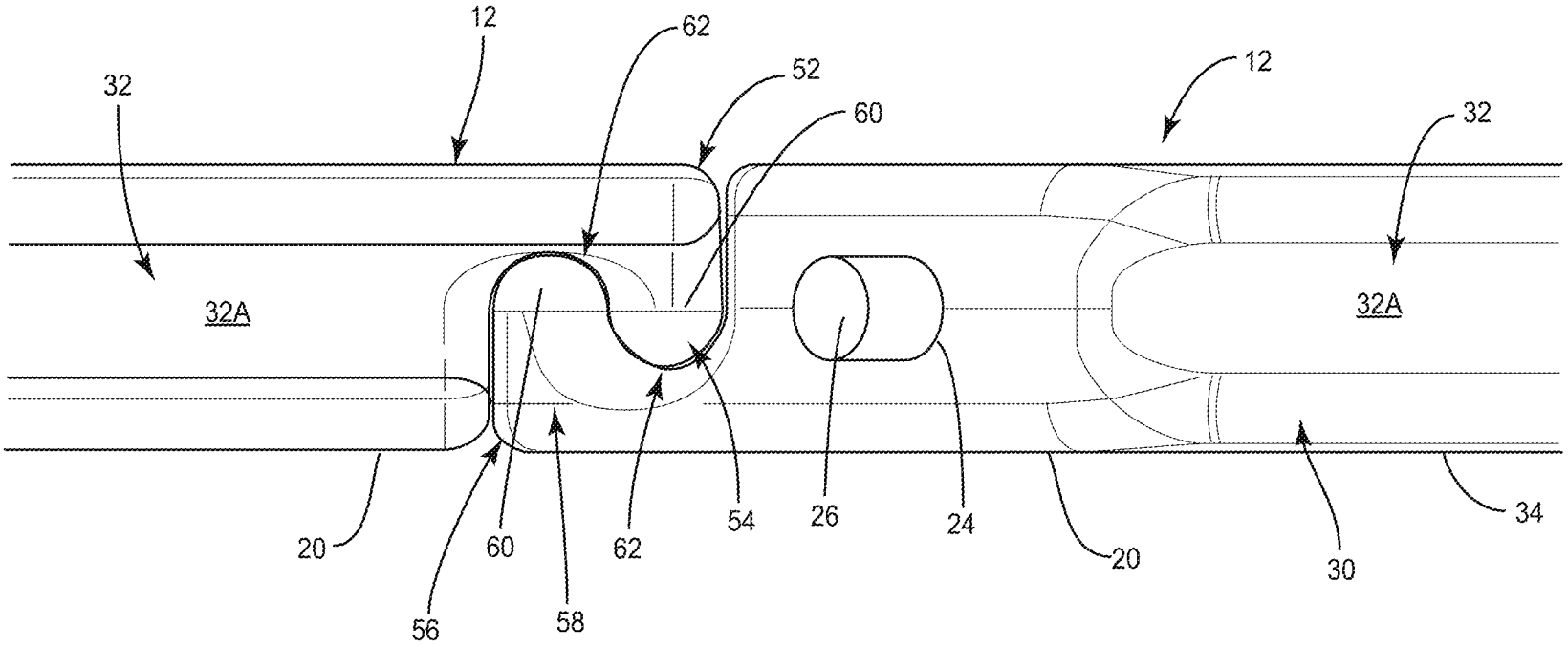

In one example construction, the first 56 and second 58 interlocking features each can include fingers or other suitable portions 60 that are configured to intermesh, interlock, or otherwise be engaged with each other for interlocking or connection of adjacent interlocking packs 12. For example, the body of the interlocking packs 12 can include grooves or slots 62 arranged along or otherwise adjacent or proximate to the fingers 60. Thus, as shown in FIGS. 3A and 3B, the fingers 60 of the first 56 and second 58 interlocking assemblies of adjacent interlocking packs 12 can be received within the corresponding grooves 62 adjacent the FIGS. 60, such that the FIG. 60 of the interlocking assemblies 56 and 58 are intermeshed, interlocked, or otherwise engaged with each other to interlock or otherwise connect adjacent interlocking packs 12. For example, the fingers 60 can snap together to provide a frictional fitted connection when adjacent interlocking packs 12 are brought into engagement with each other for connecting or interlocking adjacent interlocking packs 12 and forming groups 12A/12B of interlocking packs 12 that can be removed from the container 100 together. As a result, the interlocking packs 12 can be removed and/or replaced when the container 100 is substantially full of cargo.

With embodiments of the present disclosure, the groups 12A/12B of interlocking packs 12 can be inserted and also removed from one side of the container—that is, all of the interlocking packs 12 can be loaded and removed from the chamber 105 through the opening 103 on a front side of the container 100. More specifically, with adjacent interlocking packs 12 being interlocked or connected together, an outermost interlocking pack can be engaged or pulled (e.g., a user can engage and pull the handle 28B of the outermost interlocking pack) to remove all of the interlocking packs from the set of rails 16, e.g., together as a unit. This can allow for the interlocking packs 12 to be changed/replaced when the container 100 is filled with cargo (e.g., when the chamber 105 is substantially full of cargo). As a result, when the PCM material of the interlocking packs 12 has melted, boiled, or otherwise changes phases, the interlocking packs 12 can be removed and replaced with additional cooled interlocking packs, e.g., with frozen PCM material to help to cool or maintain a temperature within the container 100.

For example, a first interlocking pack 12 can be slid or otherwise received between a first rail 16A (or 16C) and a second rail 16B (or 16C) of a set of rails of the rail system 14. Thereafter, a second interlocking pack 12 can be slid into or otherwise received between the first and second 16A/C and 16B/C rails of the set of rails. When the second interlocking pack 12 is slid in between the set of rails 16A/C and 16B/C and into engagement with the first interlocking pack 12, the second interlocking pack 12 is interlocked with the first interlocking pack 12 such that the first interlocking pack 12 and the second interlocking pack 12 slide in concert with one another. More specifically, a finger 60 on a distal end 52 of the second interlocking pack 12 can be engaged with a finger 60 on a proximal end 56 of the first interlocking pack 12 to form a group or set 12A/12B of interlocking packs. In addition, a third interlocking pack 12 can be slid into or otherwise received between the first and second 16A/C and 16B/C rails of the set of rails and into engagement with the second interlocking pack 12, such that the third interlocking pack 12 is interlocked with the second interlocking pack 12 (and the first interlocking pack 12 via the second interlocking pack 12). More specifically, a finger 60 on a distal end 52 of the third interlocking pack 12 can be engaged with a finger 60 on a proximal end 56 of the second interlocking pack 12 to add the third interlocking pack 12 the group 12A/12B of interlocking packs. An additional interlocking pack (or packs) also can be slid in between the set of rails and interlocked with third interlocking pack or suitable adjacent interlocking packs to be added to the group. And, when a user wants to remove the group 12A/12B of interlocking packs, e.g., when the PCM of one or more of the interlocking packs 12 has melted or otherwise changed phases, the user can engage and/or pull the handle 28B of the third interlocking pack 12 (or an additional interlocking pack 12) to remove the group 12A/12B of interlocking packs (including the first, second, third and any additional interlocking packs) for the set of rails and the container 100 from the opening 103.

Variation 1:

An air cargo container, comprising:

a plurality of panels at least partially defining a chamber configured for receipt of cargo therein;

a plurality of sets of rails connected to the plurality of panels; and a plurality of modular, interlocking packs configured to be engaged or supported by the plurality of sets of rails, each modular, interlocking pack including a PCM and being configured to be received by a set of rails of the plurality of sets of rails for support of the plurality of modular, interlocking packs within the chamber, and each pack further being configured to interlock with at least one adjacent pack of the plurality of modular, interlocking packs to form groups of modular, interlocking packs, such that the groups of modular, interlocking packs are removable from the chamber upon engagement of one modular, interlocking pack each of the groups of the modular, interlocking packs.

Variation 2:

The air cargo container according to Variation 1, wherein the one modular, interlocking pack includes a foremost modular, interlocking pack of each of the groups.

Variation 3:

The air cargo container according to Variation 1, wherein the groups of modular, interlocking packs can be removed and replaced from one side of the air cargo container.

Variation 4:

The air cargo container according to Variation 3, wherein the groups of modular, interlocking packs can be removed and replaced when the chamber of the air cargo container is generally full of cargo.

Variation 5:

The air cargo container according to Variation 1, wherein each modular, interlocking pack of the plurality of modular, interlocking packs includes a first attachment assembly and a second attachment assembly, and wherein the first attachment assembly of one of the modular, interlocking packs is configured to be connectable to the second attachment assembly of another of the modular, interlocking packs.

Variation 6:

The air cargo container according to Variation 5, wherein the first and second attachment assemblies each include fingers that are configured to interlock or intermesh.

Variation 7:

The air cargo container according to Variation 1, wherein each modular, interlocking pack includes at least one guidance feature configured to interact with a rail of the sets of rails.

Variation 8:

The air cargo container according to Variation 7, wherein the at least one guidance feature includes a groove or slot defined in a body of the modular, interlocking packs.

Variation 9:

The air cargo container according to Variation 1, wherein each modular, interlocking pack includes a handle or other engagement feature to facilitate loading and removal thereof.

Variation 10:

A method, comprising:

positioning a first modular, interlocking pack along a set of rails connected to a panel of an air cargo container;

positioning a second modular, interlocking pack along the set of rails;

moving the second modular, interlocking pack into engagement with the first modular, interlocking pack to connect the first and second modular, interlocking packs and form a group of interconnected modular, interlocking packs; and removing the group by engaging the second modular, interlocking pack.

Variation 11:

The method according to Variation 10, wherein removing the group by engaging the second modular, interlocking pack includes removing the group from a cargo container that is generally full.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A cargo container, comprising:

a plurality of panels defining a chamber having an opening, the opening configured for loading and unloading of cargo in the chamber, the plurality of panels includes a first panel;

a first set of rails connected to the first panel and disposed within the chamber;

a first pack slidably received on the first set of rails, the first pack including a phase-change material (PCM) disposed therein; and a second pack slidably received on the first set of rails and interlocked with the first pack such that the first and second pack slide on the first set of rails in concert with one another, the second pack including a PCM disposed therein, the first pack and the second pack each including grooves or slots on opposite sides thereof, each groove or slot configured to receive a rail of the sets of rails to secure a respective one of the first pack or the second pack to the set of rails.

2. The cargo container according to claim 1, wherein the first pack and second pack are removable and replaceable from within the chamber when the chamber is full of cargo.

3. The cargo container according to claim 1, further comprising a closure having an open position in which the chamber is accessible through the opening and a closed position in which the opening is substantially closed such that the closure prevents access to cargo within the chamber.

4. The cargo container according claim 1, wherein the first pack includes a first attachment assembly, the second pack includes a second attachment assembly, the first attachment assembly of the first pack interlocked with the second attachment assembly of the second pack.

5. The cargo container according to claim 4, further comprising a third pack slidably received on the first set of rails and interlocked with the second pack such that the first pack, the second pack, and the third pack slide on the first set of rails in concert with one another, the third pack including a PCM disposed therein.

6. The cargo container according to claim 5, wherein the second pack includes a first attachment assembly opposite the second attachment assembly thereof, the third pack including a second attachment assembly, the first attachment assembly of the second pack interlocked with the first attachment assembly of the second pack.

7. The cargo container according to claim 4, wherein the first attachment assembly and second attachment assembly each include a finger that is configured to interlock with a finger of an adjacent attachment assembly.

8. The cargo container according to claim 1, wherein the first pack and the second pack each include a handle to facilitate loading and removal thereof.

9. The cargo container according to claim 8, wherein the handle is a through hole defined in a body of the respective pack.

10. The cargo container according to claim 1, wherein the first panel is a side panel.

11. The cargo container according to claim 1, wherein the first panel is a top panel.

12. A temperature control pack assembly for a cargo container, the temperature control pack assembly comprising:

a first temperature control pack and a second temperature control pack, each of the first temperature control pack and the second temperature control pack including:

a body defining a cavity therein, the cavity including a phase-change material (PCM) disposed therein, the body having a first interlocking feature on a first side of the body including a first finger and a second interlocking feature on a second side, opposite of the first side, of the body including a second finger, wherein the first finger of the first temperature control pack is interlocked with the second finger of the second temperature control pack such that the first temperature control pack and the second temperature control pack are interlocked on end with one another such that the temperature control pack assembly has a length equal to the sum of the length of the first temperature control pack and the second temperature control pack.

13. A cargo container, comprising:

a plurality of panels defining a chamber having an opening, the opening configured for loading and unloading of cargo in the chamber, the plurality of panels includes a first panel;

a first set of rails connected to the first panel and disposed within the chamber;

a first pack slidably received on the first set of rails, the first pack including a phase-change material (PCM) disposed therein;

a second pack slidably received on the first set of rails and interlocked with the first pack, the second pack including a PCM disposed therein; and a third pack slidably received on the first set of rails and interlocked with the second pack such that the first pack, the second pack, and the third pack slide on the first set of rails in concert with one another, the third pack including a PCM disposed therein.

14. The cargo container according to claim 13, wherein the first pack and second pack are removable and replaceable from within the chamber when the chamber is full of cargo.

15. The cargo container according to claim 13, further comprising a closure having an open position in which the chamber is accessible through the opening and a closed position in which the opening is substantially closed such that the closure prevents access to cargo within the chamber.

16. The cargo container according to claim 13, wherein the first pack and the second pack each include grooves or slots on opposite sides thereof, each groove or slot configured to receive a rail of the sets of rails to secure a respective one of the first pack or the second pack to the set of rails.

17. A cargo container, comprising:

a plurality of panels defining a chamber having an opening, the opening configured for loading and unloading of cargo in the chamber, the plurality of panels includes a first panel;

a first set of rails connected to the first panel and disposed within the chamber;

a first pack slidably received on the first set of rails, the first pack including a phase-change material (PCM) disposed therein, the first pack including a first attachment assembly that includes a first finger and a second attachment assembly that includes a second finger; and a second pack slidably received on the first set of rails and including a PCM disposed therein, the second pack including a first attachment assembly that includes a first finger and a second attachment assembly that includes a second finger, the first finger of the second pack interlocked with the second finger of the first pack such that the first and second pack slide on the first set of rails in concert with one another.

18. The cargo container according to claim 17, wherein the first pack and second pack are removable and replaceable from within the chamber when the chamber is full of cargo.

19. A temperature control pack assembly for a cargo container, the temperature control pack assembly comprising:

a first temperature control pack and a second temperature control pack, each of the first temperature control pack and the second temperature control pack including:

a body defining a cavity therein, the cavity including a phase-change material (PCM) disposed therein, the body having a first interlocking feature on a first side of the body and a second interlocking feature on a second side, opposite of the first side, of the body, the body defining a grooves or slots on opposite sides thereof, each groove or slot configured to receive a rail of a set of rails to secure the pack to the set of rails, wherein the first interlocking feature of the first temperature control pack is configured to interlocked with the second interlocking feature of the second temperature control pack such that the first temperature control pack and the second temperature control pack are interlocked on end with one another.

* * * * *